United States Patent [19]

Catallo

[11] 4,447,938

[45] May 15, 1984

[54] METHOD AND APPARATUS UTILIZING AN IMPACT BLADE FOR THE COMPRESSIVE TREATMENT OF FABRIC

[76] Inventor: Frank Catallo, 84 Wheatley Rd., Old Westbury, N.Y. 11568

[21] Appl. No.: 368,202

[22] Filed: Apr. 14, 1982

Related U.S. Application Data

[60] Division of Ser. No. 195,301, Oct. 8, 1980, Pat. No. 4,363,161, which is a continuation-in-part of Ser. No. 095,090, Nov. 16, 1979, abandoned.

[51] Int. Cl.[3] ..... D06C 21/00

[52] U.S. Cl. ..... 26/18.6; 28/103

[58] Field of Search ..... 26/18.6; 28/103; 162/111, 280, 361

[56] References Cited

U.S. PATENT DOCUMENTS 1,548,790 8/1925 Lorenz ..... 162/280 X 3,564,677 2/1971 Kalwaites ..... 28/103 X

*Primary Examiner*—Robert Mackey

*Attorney, Agent, or Firm*—Pennie & Edmonds

[57] ABSTRACT

An apparatus for compressing a web W of fibrous material where the apparatus includes a first surface (3) movable in one direction and a second surface (5) movable in an opposite direction at a speed slower than the speed of movement of the first surface. A confining means (7) having an apex (10) extends between the surfaces. A stuffing chamber (13) is formed between the two surfaces and the confining means. Movement of the first surface feeds a web of material into the stuffing chamber and movement of the second surface moves compressed material out of the chamber.

A method of compressing a web W of fibrous material where said material is forced into a stuffing chamber (13) formed between a confining means (7) having an apex (10) and two surfaces (3 and 5). A web of material is fed into the stuffing chamber by moving one of the surfaces in one direction at a particular speed. Compressed material is removed from the stuffing chamber by moving the second surface in a direction opposite to that of the first surface and at a slower speed than that of movement of the first surface.

4 Claims, 9 Drawing Figures

METHOD AND APPARATUS UTILIZING AN IMPACT BLADE FOR THE COMPRESSIVE TREATMENT OF FABRIC

This application is a Division of application Ser. No. 195,301, filed Oct. 8, 1980, now U.S. Pat. No. 4,363,161 granted Dec. 14, 1982, which is a continuation-in-part of application Ser. No. 095,090, filed Nov. 16, 1979, now abandoned.

FIELD OF THE INVENTION

The invention relates to an apparatus for the compressive treatment of a fibrous web material in order to mechanically impart pre-shrinkage properties to the material.

BACKGROUND OF THE INVENTION

A number of different machines and methods have been proposed to effect a compressive force on fibrous thread interlaced web material in order to impart pre-shrinkage properties. One such method and apparatus is disclosed in U.S. Pat. Nos. 2,765,513 and 2,765,514 both to Walton which disclose application of compressive forces along short columnar lengths of a fabric. The machine disclosed for imparting the compressive forces utilizes two spaced rolls rotating in opposite directions at different speeds and between which fabric is fed. A fabric indentor forces the fabric into the rubber surface of the faster rotating roll prior to the fabric being fed to the nip between the rolls with the result that a short columnar length of fabric between the indentor and nip is compressed. The method and apparatus has not been entirely successful in compressing all fabrics made up of fibrous thread interlaced web material since some fabrics, for example knit fabrics, have yarns which do not extend in lengthwise or columnar directions such that it is difficult to apply a compressive force to these yarns.

Other methods and machines have also used opposed rolls rotating in opposite directions at different speeds but utilizing a compactor shoe spaced from the faster moving roll rather than fabric indentors. In such instances, the faster moving roll acts as a feed roll to force a fabric material between it and the compactor shoe after which the material is fed to the nip between the rolls where the material is ironed to set the fibers or yarns in place. An example of this type of apparatus is disclosed in U.S. Pat. No. 3,015,145 to Cohn et al. A problem with apparatus of this type where opposed rolls rotating in opposite directions are utilized, as well as with the same type of apparatus as described above utilizing a fabric indentor, is that the faster rotating roll tends to scuff the material in the nip area making it difficult to treat material having dark colors.

Machines for effecting a compressive fibrous force on material have also utilized pairs of endless belts which are spaced from each other and which move in the same linear direction. The belts used are such that the linear speed of the surface of the belt may be changed by varying belt thickness with the result that when material fed between the belts is to be longitudinally compressed, the spacing between the belts is increased by decreasing the belt thickness which results in the surface speed of the belt being reduced so as to act as a retarding force on the material. Such a device is disclosed in U.S. Pat. Nos. 3,007,223 and 3,195,212 both to Wehrmann. The compressive effect utilizing belts however is limited by the belt thickness and construction.

Further, the belts are relatively expensive and require extensive maintenance.

A still further apparatus and method has been disclosed which utilizes a straight movable member which is spaced from a stationary member where the movable member acts as a feed member to feed material through a space between the stationary member and a fixed retarding member in the form of a wedge to impart columnar type compression onto the material. Such a method is disclosed in U.S. Pat. No. 3,426,405 to Walton.

A difficulty with all of the methods and machines of which I am aware is that they do not provide means by which the fibers or yarns making up the material may be worked or kneaded while the material is in a compressed state in order that the fibers or yarns may slip relative to each other or, in the case of a knitted fabric, where the individual stitches may be repositioned due to the working or kneading action of the yarns.

Further, the prior art devices of which I am aware do not provide for means by which individual fibers or yarns comprising a web of material may move or slip with respect to each other due to any increase in diameter of the fibers or yarns resulting from puffing or swelling because of the application of heat and when the material is in a compressed or relaxed state.

It is therefore an object of my invention to provide for a method and apparatus for the compressive treatment of a fibrous material, for example a fibrous web material, whereby individual fibers making up the material may be kneaded or worked while compressive forces are being applied to the material.

It is a further object of my invention to provide for a method and apparatus for the compressive treatment of a fibrous material in which individual yarns or fibers of a material may be subjected to heat or steam in order that the fibers may puff or expand while the material is in a compressed state.

GENERAL DESCRIPTION OF THE INVENTION

Broadly a method according to my invention comprises forcing a fibrous web material, for example a fibrous thread interlaced web material into a stuffing chamber where the stuffing chamber is formed by a confining means having an apex and two movable surfaces with the apex extending in part between the surfaces. One of the surfaces is moved with respect to the confining means in a direction towards the stuffing chamber at a particular speed in order to feed a web of material into the chamber. The second movable surface moves in a direction substantially opposite to the direction of movement of the first surface and at a slower speed to move compressed material out of the stuffing chamber. Since both movable surfaces move in the same direction as the web of material, they do not impart any scuffing action onto the material. The two movable surfaces may be positioned close to each other to decrease the size of the stuffing chamber such that the material forced into the chamber is caused to contact and to turn about the apex of the confining means. This results in a kneading or working action being imparted upon the fibers or yarns making up the material which assists slippage and repositioning of the fibers while the material is in a compressed state. Where even a greater reduction of shrinkage potential is desired, an impact blade may be positioned between the first and second movable surfaces to extend into the stuffing chamber to prevent movement of fabric into the space between the movable surfaces caused by the compressive forces exerted on the fabric. When the two surfaces are positioned further apart to enlarge the stuffing chamber, the material in the stuffing chamber will be slightly spaced from the apex such that both sides of the web of the material will be spaced from the walls of the stuffing chamber a slight amount. This allows easy repositioning of stitches when a knitted material is being processed and when the material is subjected to a heat or steam treatment in order to puff or swell individual yarns.

The method may involve moving both surfaces in opposite peripheral directions at the area of the stuffing chamber where the surfaces comprise outer surfaces of adjacent rolls rotating in the same direction. In a further embodiment of the method, one of the surfaces may be moved in a peripheral direction while the other surface is moved in an opposite linear direction where the surface moving in the peripheral direction comprises the outer surface of a roll and where the surface moving in the linear direction comprises part of an endless belt adjacent the roll. In both embodiments, it is important that the two surfaces engaging the material move in opposite directions so that they follow movement of the material through the stuffing chamber and so prevent scuffing.

Broadly, an apparatus constructed according to the invention comprises a first movable surface movable at a particular speed in a first direction. A second movable surface is provided adjacent the first movable surface in a second direction opposite to that of the first surface and at a speed slower than that of the first surface. A confining means having an apex is provided to extend part-way between the two surfaces whereby the space between the two surfaces and the confining means defines a stuffing chamber. An impact blade may extend between the two movable surfaces into the stuffing chamber towards the confining means to prevent fabric being forced between the two surfaces under high compression forces. In one form of the invention, both surfaces comprise adjacent rolls rotatable in the same direction and where the apex of the confining means extends towards the nip between the rolls.

In one embodiment of the invention, the confining means is in the form of a gull-shaped member having two wings with one wing being spaced from the first and faster moving roll which acts as a feed roll to feed material into the stuffing chamber. The other wing is spaced from the second and slower moving roll to feed material out of the stuffing chamber. Means may be provided for moving the gull-shaped member towards and away from a line connecting the roll centers whereby the spacing between the wings and the rolls may be varied to accommodate different thicknesses of material. Also, the gulf-shaped member may have means for varying the angle between the wings to also vary the spacing between the wings and the rolls. The confining means may also take the form of a semi-gull-shaped member having one wing only.

A further embodiment of the apparatus of the invention may have one of the surfaces, namely the faster moving surface take the form of a roll and the slower moving surface take the form of an endless belt adjacent the roll where the belt moves in a linear direction opposite to the peripheral direction of the roll.

The confining means may be equipped with heating means in order to facilitate setting of the material in the stuffing chamber after it has been compressed. Further, steam jet means may be provided for directing a jet of steam between the surfaces into the stuffing chamber in order to puff and enlarge individual fibers and yarns making up the material, or, by using superheated steam, to set the fibers or yarns when a synthetic material is being compressed.

BEST MODES FOR CARRYING OUT THE INVENTION

Figure 1:
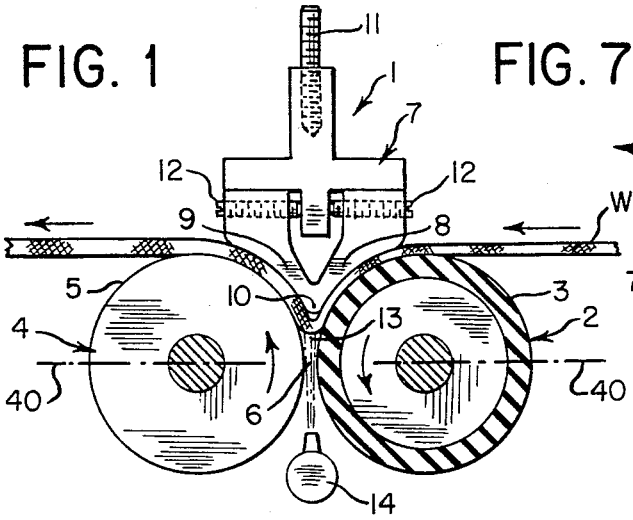
FIG. 1 is a diagrammatical side sectional view of an apparatus constructed according to the invention.

Referring to FIG. 1, there is illustrated an apparatus 1 for the compressive treatment of a web W of fibrous material, for example a fibrous thread interlaced web material, which is fed by a roll 2 having a first uninterrupted surface 3 on its outer periphery and which rotates in the direction of the arrow shown. A roll 4 which has a second uninterrupted surface 5 thereon is positioned adjacent to and spaced from the roll 2. Roll 4 rotates in the same direction as roll 2 such that the surfaces 3 and 5 move in opposite peripheral directions at the roll nip area 6.

A confining means 7 in the form of a gullshaped member having wings 8 and 9 which join together at the apex 10 is positioned above the rolls. As shown, apex 10 of the confining means has a smooth arcuate surface and extends between the surfaces 3 and 5 on the rolls and is directed towards the nip area 6. The confining means 7 includes adjustment means 11 by which the confining means may be moved vertically with respect to a line 40 joining the roll centers so as to vary the spacing between the wings and the surfaces 3 and 5 of the rolls 2 and 4. The confining means also includes adjustment means 12 in the form of screws such that the angle between the wings at the apex may be varied to further control the spacing between the wings and the surfaces of the rolls. A steam jet means 14 is included in order to inject a jet of steam through the spacing between the rolls 2 and 4 to treat material contained in a stuffing chamber 13 defined by the space between the apex 10 and the nip area 6 between rolls 2 and 4.

Figure 3:
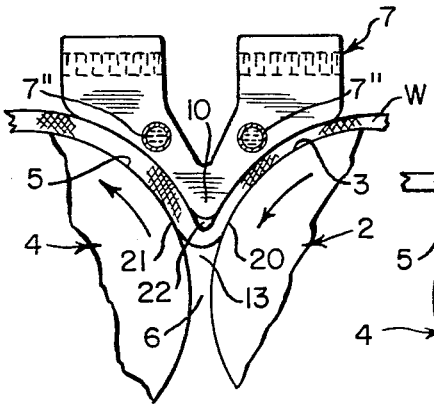
FIG. 3 is an enlarged view of a portion of FIG. 1 illustrating spacing of the material from the sides of the stuffing chamber.

As shown, the material W prior to compression is fed by the roll 2 through the space between the roll 2 and wing 8 into the stuffing chamber 13. Roll 4 rotates at a slower speed than roll 2 so that it imparts a retarding force on the web of the material W. This results in longitudinal compressive forces being exerted on the web of material from approximately the point 20 as shown in FIG. 3 near where the web enters into the stuffing chamber and the point 21 near where the web exists the stuffing chamber. As shown, the web W is turned around the apex 10 such that a space 22 is formed between the upper side of the web and the apex. Further, there is also a space on the bottom side of the web opposite space 22 so that a portion of the web is free from contact with any structure and to this extent is self-supporting. This self-supporting feature allows free sliding movement of the fibers making up the material throughout the entire thickness of the material including both the top and bottom sides of the material resulting in a complete stress release of the fibers while the material is in a compressed state. Where the material being treated comprises a knitted fabric, the self-supporting feature allows the knitted loops of yarn to slip relative to each other while the fabric is in a compressed untensioned state.

Figure 2:
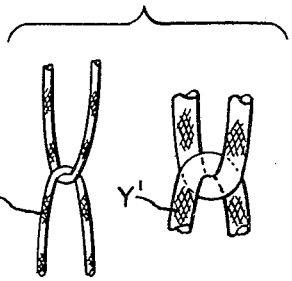
FIG. 2 is an enlarged view of individual yarns before and after heat treatment resulting in puffing of the yarns.

It is desirable in some instances to treat a material with steam in order to puff or enlarge individual yarns. Referring to FIG. 2, yarn Y forming part of a knitted loop is shown before being treated by steam while yarn Y′ illustrates the same yarn and loop after being treated with steam and after it has been puffed or swollen. The puffing or swelling of the yarn increases its diameter and tends to move the centers of looped yarns apart resulting in shortening of the loops and consequently shortening of the material as is apparent by comparing the lengths of the loops in FIG. 2. This normally results in objectionable stresses being imparted into the fabric. The self-supporting feature as described previously allows the loops of the puffed yarn to shift or slide with respect to each other thus preventing any stress build up in the fabric due to puffing. The confining means 7 if desired may contain heating means 7″ in order to set synthetic fibers or yarns in the material while the material is in a compressed unstressed state. Also, the steam jet 14 could utilize a superheated steam for this purpose.

The roll 2 may have a rubber surface to increase its frictional properties with respect to the material so as to provide a non-slip feed surface if such is needed.

Figure 4:
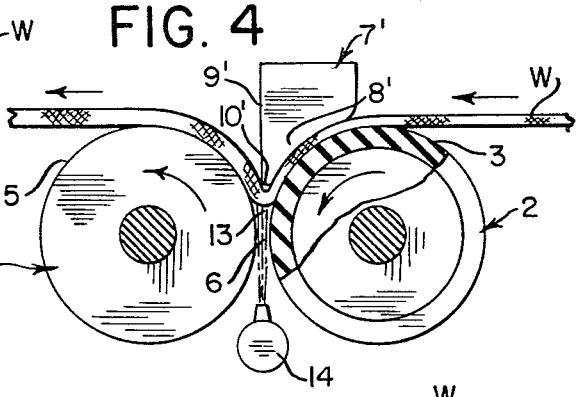
FIG. 4 is a view similar to FIG. 1 illustrating a modified form of a confining means.

Referring to FIG. 4, a further embodiment of the invention is shown which is generally similar to the embodiment of FIG. 1 with the exception that the confining means 7′ comprises a semi-gull-shaped member having a single wing 8′ and a generally flat surface 9′ which joins with the wing at the apex 10′ having a smooth arcuate surface and which extends generally tangentially to the rolls 2 and 4. In this instance, the stuffing chamber is formed between the surface of the rolls 2 and 4 and the apex 10′. In all other respects, the apparatus is the same as that shown in FIG. 1.

Figure 5:
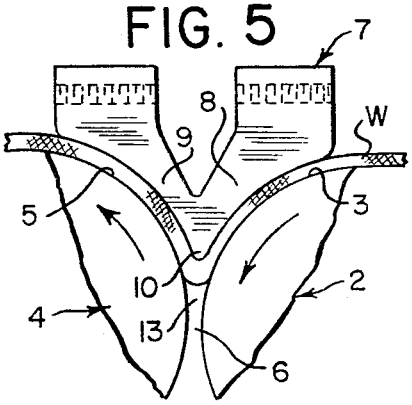
FIG. 5 is a view similar to FIG. 3 illustrating material in contact with the apex of a confining member.

Referring to FIG. 5, there is shown a condition in which the rolls 2 and 4 are positioned closer to each other than in FIG. 3 thus decreasing the width of the nip area 6. This results in a decrease of the size of the stuffing chamber 13 such that the web of fibrous material is forced against the apex 10 of the confining means 7 as it moves through the stuffing chamber. As the material moves around the apex, the fibers will be worked or kneaded as they slip around the apex thus increasing their ability to slide with respect to each other and, in the case of knit fabrics, for the yarn loops to slide with respect to each other to release stresses therein.

As shown in both the embodiments of FIGS. 3 and 5, the spacing between the wing 9 and the roll surface 5 of the roll 4 should be greater than the spacing between the wing 8 and surface 3 of the roll 2 in order to accommodate the increased thickness of the web W caused by compression.

Figure 6:
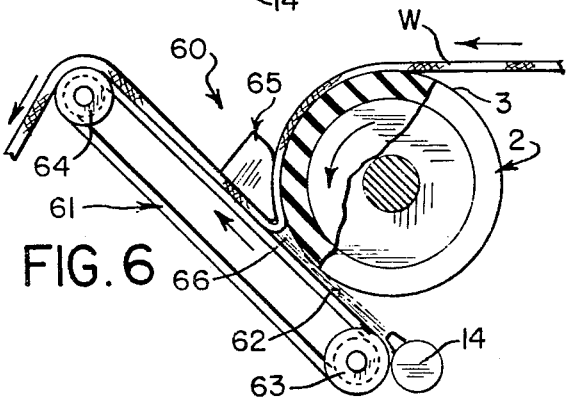
FIG. 6 is a diagrammatical side sectional view of a further embodiment of an apparatus constructed according to the invention.

Referring to FIG. 6, there is illustrated a further form of the invention where the apparatus 60 comprises a roll 2 having an uninterrupted peripheral surface 3 which is combined with an endless belt 61 having an uninterrupted linear surface 62 which extends between two pulleys 63 and 64. A confining means 65 similar to the confining means 7′ of FIG. 4 is included so that a stuffing chamber 66 is formed between the confining means 65 and the surface 3 of roll 2 and surface 62 of belt 61. The belt 61 is driven at a speed such that the speed of linear movement of the surface 62 is less than the speed of the peripheral movement of the surface 3. As with the case of the embodiments of FIGS. 1, 4 and 5, the direction of movement of the surface 62 is opposite to the direction of movement of the surface 3 at the stuffing chamber.

Figure 7:
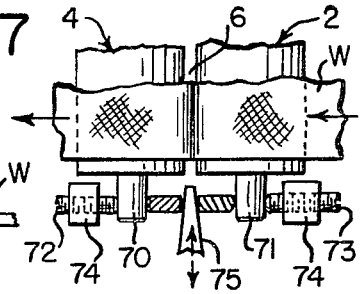
FIG. 7 is a diagrammatical plan view of a further embodiment of the invention illustrating means for varying spacing between movable surfaces forming part of a stuffing chamber.
Figure 8:
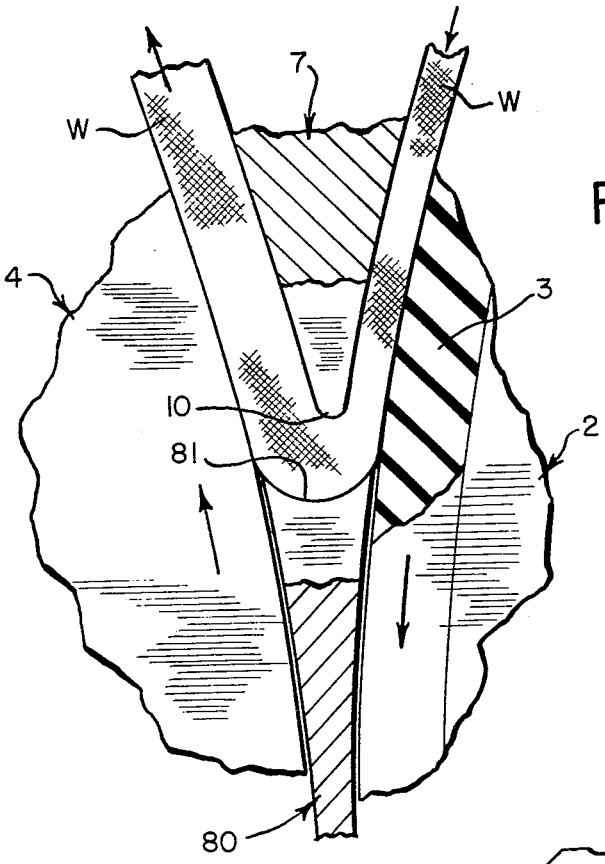
FIG. 8 is an enlarged view of a portion of a further embodiment of an apparatus constructed according to the invention utilizing an impact blade.

Referring to FIG. 7, there is illustrated a means for moving the rolls 2 and 4 relative to each other to vary the spacing of the nip area 6 as shown in FIGS. 3 and 5. Bearing blocks 70 and 71 rotatably mount the roll shafts (not shown). Blocks 70 and 71 are moved towards each other by screws 72 and 73 mounted in a fixed portion 74 of the frame of the apparatus and are moved away from each other by a wedge 75. Similar means may be used with the form of the invention illustrated in FIG. 6 for moving the roll 2 relative to the belt 61.

Where greater shrinkage control is required, the fabric must be compacted to a greater amount in the stuffing chamber formed between the moving surfaces and the confining means. Under high fabric compression forces, the fabric tends to be forced into the nip area between the moving surfaces instead of around the apex of the confining means with the result that the fabric will not flow at a relatively fast speed into the chamber and at a slower speed out of the chamber. In order to prevent this from occurring, I include an impact blade 80 which, as shown in FIG. 8, is positioned between the rolls 2 and 4 and includes a concave surface 81 to guide the fabric about the apex of the confining means 7.

Figure 9:
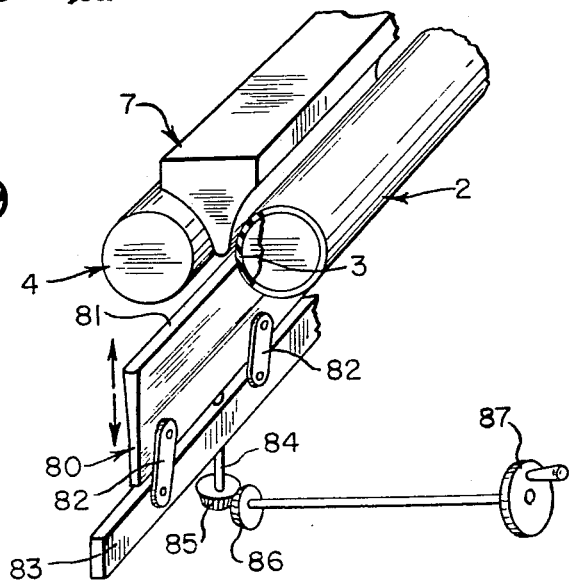
FIG. 9 is a diagrammatical perspective view of a means for moving an impact blade of the type illustrated in FIG. 8.

Referring to FIG. 9, there is illustrated impact blade adjustment means for moving the blade towards or away from the confining means 7 in order to regulate the size of the stuffing chamber for thick or thin fabrics. As shown, the blade 80 is connected by parallel links 82 to a reciprocally movable bar 83. Bar 83 has a rack thereon (not shown) engaging a gear (not shown) on the end of shaft 84. Shaft 84 in turn is connected by bevel gears 85 and 86 to an impact blade adjustment hand wheel 87. When wheel 87 is turned, bar 83 is caused to move in a longitudinal direction thus causing the blade 80 to move in a vertical direction and thus vary the distance between the apex 10 and the guide surface 81 of the blade.

An advantage of all of the embodiments illustrated is that, since the surfaces contacting the web adjacent the stuffing chamber move in opposite directions, there is no tendency of one surface to slide with respect to the web and thus scuff the web as would occur if both surfaces moved in the same direction at different speeds.

The method of operation of the embodiments is as follows. The confining means is positioned to give a desired spacing between it and the surface 3 of the feed roll 2 and the surface of the roll 4 or belt 61. The spacing between the rolls 2 and 4 or between the roll 2 and belt 61 is set so as either to form an enlarged stuffing chamber whereby the web will be self-supporting and not be engaged by the apex of the confining means or to form a smaller stuffing chamber where the web will contact the apex. The web of material is then introduced onto the roll 2 where it is fed into the stuffing chamber at a particular speed. The roll 4 or the belt 61 is rotated in the same direction as the roll 2 such that at the nip area, the surface of the roll 4 or the belt 61 will move in a direction opposite to the peripheral direction of movement of the surface of the roll 2. The surface of the belt 61 or roll 4 is moved at a slower speed than that of the roll 2 so as to move the compressed fabric out of the stuffing chamber.

If desired, steam may be introduced to puff the fibers making up the web, and in the case of synthetic fibers, the steam introduced may be superheated steam to assist in setting of the fibers. Heat may also be applied to the confining means if it is desired to set the fibers.

I claim:

1. An apparatus for the compressive treatment of a fibrous material where the apparatus comprises a first movable surface, means for moving said first movable surface in a first direction at a first rate of speed, a second movable surface spaced from said first movable surface, means for moving said second movable surface in a second direction opposite to said first direction at a second rate of speed slower than said first rate of speed, a confining means spaced from said first and second movable surfaces having an apex extending between and towards said surfaces to form a stuffing chamber therewith into which material is adapted to be moved by said first movable surface and from which material is adapted to be moved by said second movable surface, and an impact blade extending between said first and second movable surfaces towards said apex for guiding flow of said material around said apex.

2. An apparatus according to claim 1 wherein said impact blade has a concave guide surface adapted to contact material in the stuffing chamber.

3. An apparatus according to claim 1 having in addition impact blade adjustment means for moving said blade relative to said apex to vary the spacing between said blade and said apex.

4. A method for the compressive treatment of a fibrous web material where said material is forced into a stuffing chamber formed by a space between a first movable cylindrical surface, a second movable surface, an apex of a confining means extending in part between and spaced from the first and second surfaces, and an impact blade extending between the first and second movable surfaces towards said apex, comprising the step of moving the first surface at a first rate of speed in a first direction to move said material between it and said confining means towards and into said stuffing chamber, the step of moving the second surface in a second direction opposite to said first direction at a second rate of speed slower than said first rate of speed to move said material in said second direction around said apex and out of said stuffing chamber, and the step of guiding flow of said material around said apex by said impact blade.

* * * * *